US011060322B2

(12) United States Patent
Lin et al.

(10) Patent No.: US 11,060,322 B2
(45) Date of Patent: Jul. 13, 2021

(54) POWERED LATCHING APPARATUS

(71) Applicant: HTI Technology & Industries, Inc., LaVergne, TN (US)

(72) Inventors: I-Chiang Lin, San Mateo, CA (US); Marshall Aurnou, Marco Island, FL (US); Roger DeYoung, Franklin, TN (US)

(73) Assignee: HTI TECHNOLOGY AND INDUSTRIES, INC., La Vergne, TN (US)

( * ) Notice: Subject to any disclaimer, the term of this patent is extended or adjusted under 35 U.S.C. 154(b) by 1091 days.

(21) Appl. No.: 15/171,782

(22) Filed: Jun. 2, 2016

(65) Prior Publication Data

US 2016/0356057 A1 Dec. 8, 2016

Related U.S. Application Data

(60) Provisional application No. 62/170,420, filed on Jun. 3, 2015.

(51) Int. Cl.
*E05B 17/00* (2006.01)
*E05B 47/00* (2006.01)
(Continued)

(52) U.S. Cl.
CPC ..... *E05B 17/0029* (2013.01); *E05B 47/0002* (2013.01); *E05B 47/0038* (2013.01);
(Continued)

(58) Field of Classification Search
CPC ... E05C 3/12; E05C 3/24; E05C 17/56; E05C 19/10; E05C 19/16; E05C 19/161;
(Continued)

(56) References Cited

U.S. PATENT DOCUMENTS 3,258,875 A * 7/1966 Ulman ..... E05C 17/56 49/379
4,326,235 A * 4/1982 Hopkins ..... E05B 47/00 292/201

(Continued)

FOREIGN PATENT DOCUMENTS

EP 0099223 A2 * 1/1984 ..... E05C 17/56
EP 1762679 A1 * 3/2007 ..... E05C 3/06

(Continued)

OTHER PUBLICATIONS

Machine Translation of WO 2016005203 A1, 2020, pp. 1-19 (Year: 2020).*

(Continued)

*Primary Examiner* — Christine M Mills
(74) *Attorney, Agent, or Firm* — Emerson, Thomson & Bennett, LLC; Roger D. Emerson

(57) ABSTRACT

An apparatus for latching a door having a latching member; a retention cam wherein the retention cam further comprises an extended face and is rotatable about its axis; a spring; a locking member; an actuator; a push out member; and a driving member; wherein the actuator drives the driving member to remove the locking member from contact with the retention cam and the driving member drives the push out member to push the latching member away from the retention cam. The apparatus is capable of assisting both in the latching and unlatching of the device.

5 Claims, 5 Drawing Sheets

(51) Int. Cl.

| | |
|---|---|
| ***E05B 65/00*** | (2006.01) |
| ***E05C 3/24*** | (2006.01) |
| ***E05C 19/10*** | (2006.01) |
| ***E05C 19/16*** | (2006.01) |
| ***E05C 17/56*** | (2006.01) |

(52) U.S. Cl.
CPC ..... *E05B 65/0042* (2013.01); *E05B 65/0046* (2013.01); *E05C 3/24* (2013.01); *E05C 17/56* (2013.01); *E05C 19/10* (2013.01); *E05C 19/16* (2013.01); *E05Y 2900/31* (2013.01); *Y10T 292/11* (2015.04)

(58) Field of Classification Search
CPC ..... E05B 17/0025; E05B 47/0038; E05B 65/0042; E05B 65/0046; E05B 17/0029; E05B 47/0002; E05B 47/0006; Y10T 292/11; Y10T 292/1077; Y10T 292/1079; Y10S 292/12; Y10S 292/71
USPC ..... 292/251.5, 197, 199, DIG. 12, DIG. 71
See application file for complete search history.

(56) References Cited

U.S. PATENT DOCUMENTS

| | | | | |
|---|---|---|---|---|
| 5,029,912 | A * | 7/1991 | Gotanda | E05B 47/0046 292/143 |
| 5,174,417 | A * | 12/1992 | Pilsbury | B66B 13/12 187/330 |
| 5,469,659 | A * | 11/1995 | Reid | E05B 47/0038 160/180 |
| 5,701,702 | A * | 12/1997 | Reid | E05B 47/0038 160/180 |
| 6,474,120 | B1 * | 11/2002 | Wadsworth | E05B 63/185 292/251.5 |
| 6,530,251 | B1 | 3/2003 | Dimig | |
| 7,267,378 | B2 * | 9/2007 | Drumm | E05C 19/163 292/251.5 |
| 10,385,895 | B2 * | 8/2019 | Fiedler | E05C 1/14 |
| 2008/0296915 | A1 | 4/2008 | Clark et al. | |
| 2008/0265589 | A1 * | 10/2008 | Allan | E05C 19/16 292/251.5 |
| 2011/0163556 | A1 | 7/2011 | Scheffler et al. | |
| 2011/0254285 | A1 * | 10/2011 | Hanchett, Jr. | E05B 15/022 290/1 R |
| 2013/0015670 | A1 | 1/2013 | Perkins | |
| 2014/0054904 | A1 * | 2/2014 | Andrews | E05C 19/163 292/144 |
| 2017/0159683 | A1 * | 6/2017 | Fiedler | E05B 15/022 |

FOREIGN PATENT DOCUMENTS

| | | | | |
|---|---|---|---|---|
| EP | 1950370 | A1 * | 7/2008 | E05C 17/56 |
| JP | 54102046 | A * | 8/1979 | |
| WO | WO-2016005203 | A1 * | 1/2016 | F16B 2/185 |

OTHER PUBLICATIONS

International Search Report and Written Opinion for corresponding PCT Application No. PCT/US2016/035814 dated Sep. 12, 2016.

* cited by examiner

POWERED LATCHING APPARATUS

FIELD OF THE INVENTION

The present invention relates to an apparatus for latching and unlatching a door. More particularly, the present invention is directed at a powered latching apparatus that couples an easy close latch with a power assisted opening.

BACKGROUND OF THE INVENTION

Current door closures can include a push-out feature wherein the door opens slightly when the latch is disengaged. The device causing the door to push out in this manner can be manual or powered, but typically includes a spring or powered latch that forces the door open as the latch is disengaged. Typically, these doors are difficult to close as they require significant effort to overcome the push out force. Additionally, some of these latches are sensitive to adjustment.

Many manufacturers of household refrigerators have enhanced user interface of their refrigerators by adding a door that is affixed to the outside of the main refrigerator door. This secondary door is known as a Door-In-Door (DID) feature. For safety reasons, industry safety standards preclude the use of locks and latches on the main refrigerator door. However, for Door-In-Door applications, manufacturers prefer to have a latch device on the DID so handles can be attached to the DID. This allows the user to pull open the main door. Additionally, manufacturers desire a convenient release of this latch for easy access to the contents located within the DID. The present invention provides this convenience by releasing the latch and partially pushing the door open.

Other door latches are simple to close but they lack a push out feature that is able to assist in opening the door.

What is needed is a door latch that is both easy to operate and close, while also providing the user with assistance in opening the unit.

SUMMARY OF THE INVENTION

Provided is an apparatus for latching a door having a latching member; a retention cam wherein the retention cam further comprises an extended face and is rotatable about its axis; a spring; a locking member; an actuator; a push out member; and a driving member; wherein the actuator drives the driving member to remove the locking member from contact with the retention cam and the driving member drives the push out member to push the latching member away from the retention cam.

The function of conveniently releasing the latch for easy access to the contents of the DID may be accomplished by moving two main features within the latch; the latch hook and any number of magnets. A motor powered mechanism of gears and a cam creates said movement. A cam plate is able to move the latch hook away from the latch striker.

DESCRIPTION OF THE DRAWINGS

To illustrate the technical solutions in the embodiments of the present invention more clearly, the following briefly introduces the accompanying drawings required for describing the embodiments of the present invention. The accompanying drawings in the following description show merely some embodiments of the present invention, and a person of ordinary skill in the art may still derive other drawings from these accompanying drawings without creative efforts.

DETAILED DESCRIPTION

Figure 1:
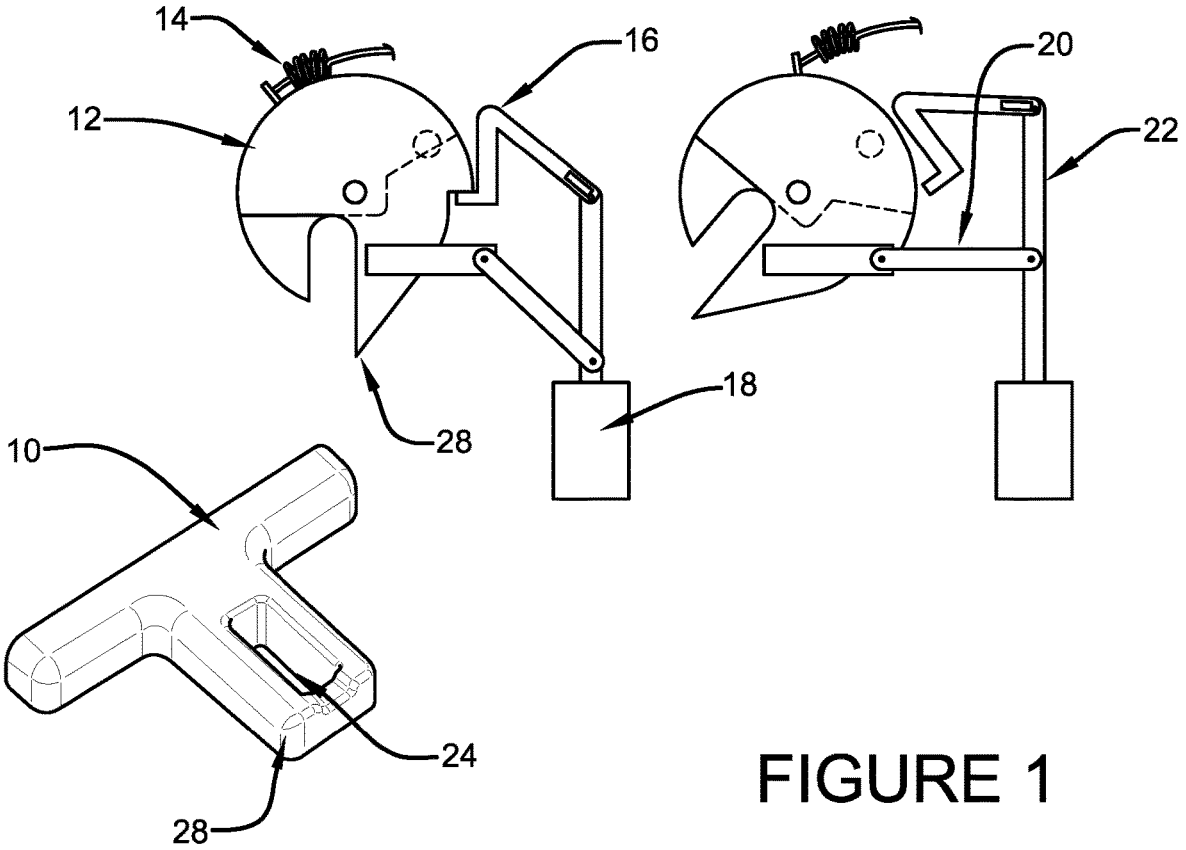
FIG. 1 is an embodiment of a powered latching apparatus.

With reference to FIG. 1, a latch member 10 can have a retention window 24. The latch member 10 can be connected to an associated door opposite the retention cam 12, which can be attached to the frame of the associated door. The retention cam 12 can have a spring 14 connecting it to a locking member 16 which can be thereby connected to a driving member 22 of an actuator 18. The actuator 18 can be electric, mechanical, hydraulic, or any other known type of actuator. Further connected to the driving member 22 is a push out member 20 that can be operable to rotate the retention cam 12 in a clockwise direction (relative to the placement as depicted in FIG. 1).

With continued reference to FIG. 1, according to this embodiment, when the latch member 10 is in an unlocked, or open, position, the retention cam 12 is partially rotated, as shown in position B of FIG. 1. In this position, the act of closing the associated door moves the latch member 10 linearly in a horizontal direction wherein the first side 26 of the latch member 10 can contact the extended face 28 of the retention cam 12. This linear movement of the latch member 10 can cause the retention cam 12 to rotate in a counter-clockwise direction (with respect to the depicted orientation) into the lock position. As the retention cam enters into the lock position, as shown in position A of FIG. 1, the locking member 16 can move into place to prevent undesired rotation of the retention cam 12 into the unlock position.

With continued reference to FIG. 1, according to this embodiment, when moving from a locked position to an unlocked position, the actuator 18 is activated which can thereby cause the driving member 22 to extend. The driving member 22 can then pivot the locking member 16 away from the retention cam 12, thereby allowing the retention cam 12 to rotate in a clockwise direction (with respect to the depicted orientation). As driving member 22 extends, push out member 20 extends perpendicularly from driving member 22 to cause the extended face 28 of the retention cam 12 to push the first side 26 of the latch member 10 horizontally away from the retention cam 12. The push out member 20 can extend beyond the plane of the extended face 28 of the retention cam 12 to further push the first side 26 of the latch member 10 away from the retention cam. According to another embodiment, the push out member 20 can contact the surface of the associated door rather than the latch member 10, thereby causing the door to open.

Figure 2:
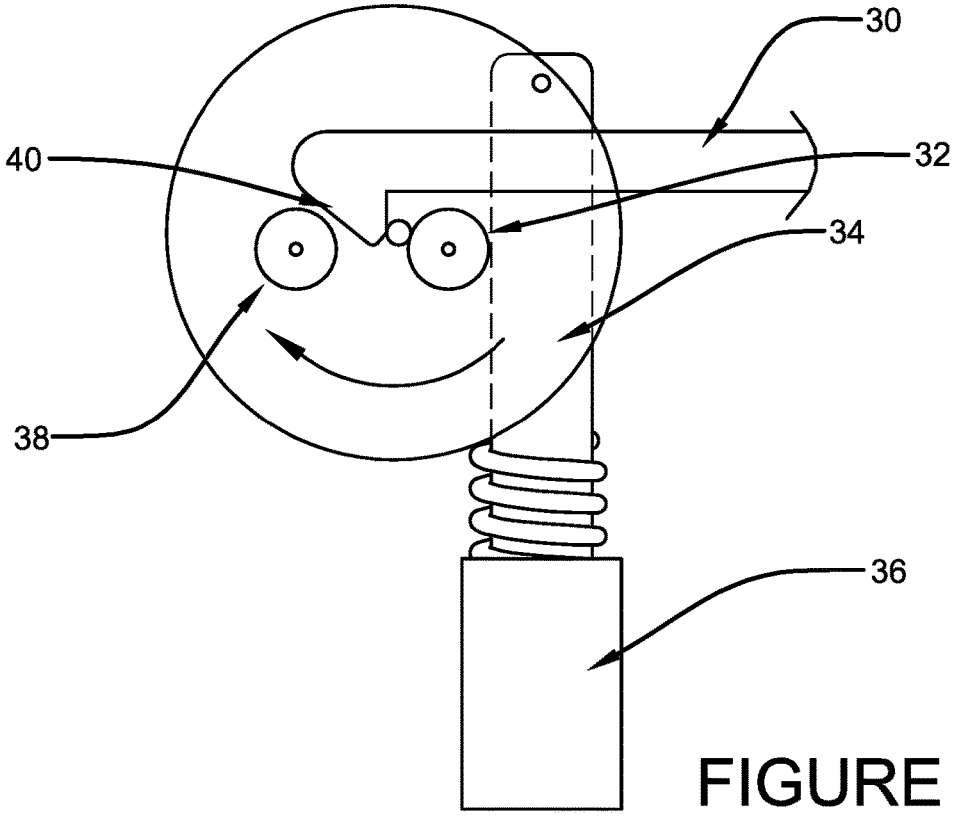
FIG. 2 is another embodiment of a powered latching apparatus.

With reference to FIG. 2, an alternative embodiment of the latching apparatus is shown. According to this embodiment, when the locking member 30 is in an unlocked position, it can move horizontally towards the retention member 32. As the locking member 30 contacts the retention member 32, the shape of the locking member 30 allows it to cause the pivoting cam 34 to rotate about its axis, causing the retention member 32 to move out of the path of travel of the locking member 30. Once the extension 40 of the locking member 30 clears the retention member 32, the pivoting cam can rotate in the opposite direction to lock the locking member 30 in place.

With continued reference to FIG. 2, according to this embodiment, when the locking member 30 is in the locked position, the powered actuator 36 can rotate the pivoting cam 34 about its axis to rotate the retention member 32 down and out of the path of travel of the locking member 30. After a few degrees of rotation, the locking member is no longer captured by the retention member. As the pivoting cam 34 continues to rotate, the push out member 38 contacts the locking member 30 and drives it horizontally away from the center axis of the pivoting cam 34, thereby driving the latching apparatus open.

Figure 3:
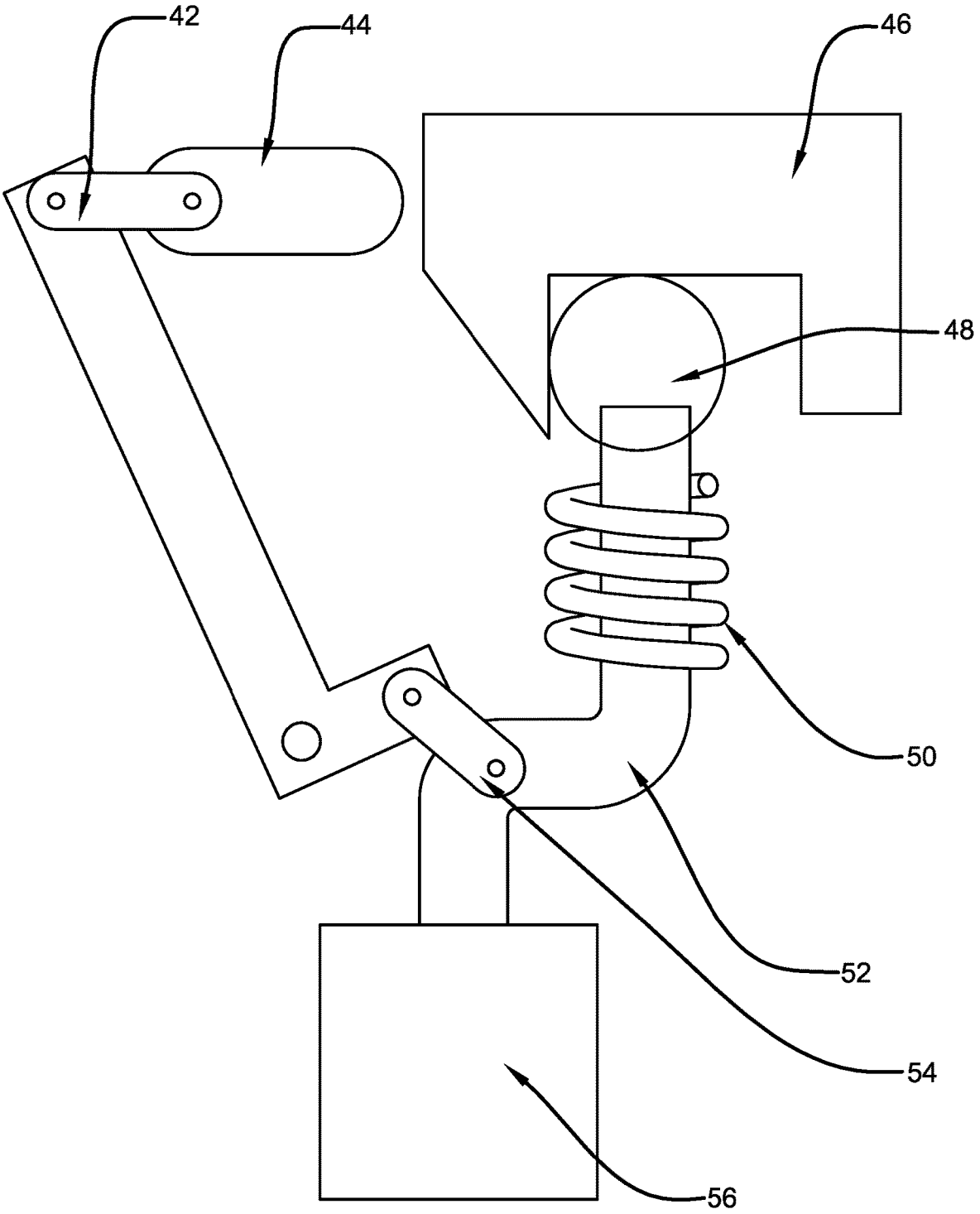
FIG. 3 is another embodiment of a powered latching apparatus.

With reference to FIG. 3, another embodiment of the latching apparatus is shown. According to this embodiment, to move from an unlocked position to a locked position, the latch member 46 can move in a horizontal direction towards the pivot member 42. As the latch member 46 contacts the roller 48, the roller 48 can give way to latch member 46, allowing latch member 46 to travel past the roller 48. Once the latch member 46 clears the roller 48, the spring 50 can force the roller 48 back into position thereby locking the latch member 46 into place.

With continued reference to FIG. 3, according to this embodiment, to move from a locked position to an unlocked position, the powered actuator 56 can be activated to move the actuation member 52 to move the roller 48 away from the latch member 46, thereby releasing the latch member 46 from the roller 48. As the actuation member 52 travels, it can cause the extension spring 54 to travel, which in turn can rotate the pivot member 42 towards the latch member 46 or towards the door. As the pivot member 42 moves towards the latch member 46, the push out link 44 contacts the latch member 46 and exerts force on the latch member 46 which can cause the latch member 46 to move horizontally away from the pivot member 42.

Figure 4:
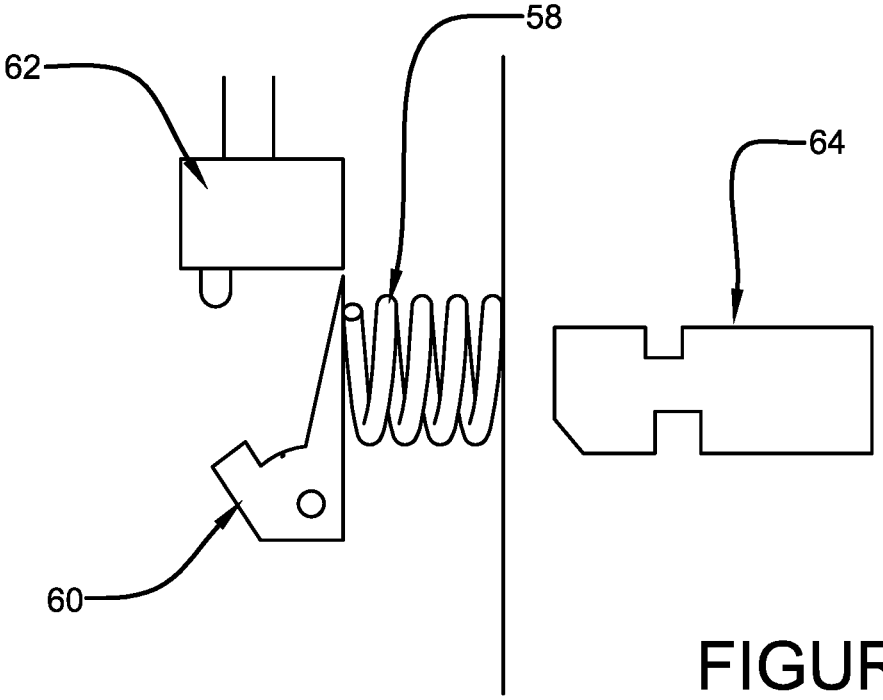
FIG. 4 is another embodiment of a powered latching apparatus, utilizing a electronically powered solenoid coil.

With reference to FIG. 4, another embodiment of the latching apparatus is shown having an electronically powered solenoid coil 58. According to this embodiment, to move from the unlocked position to the locked position, the electronically powered solenoid coil 58 can generate a magnetic field which can pull the latching member 64 towards the locking member 60 as the latching member 64 can be within a set distance from the solenoid coil 58. As the latching member 64 is pulled in to its final position by the magnetic field the latching member 64 actuates the sensor 62 which provides electrical feedback to the system indicating that the latching member 64 has reached the lock position which can turn the power to the solenoid coil 58 off.

With continued reference to FIG. 4, according to this embodiment, to move from a locked to an unlocked position, the solenoid coil 58 is powered which can magnetically activate the locking member 60 which can allow the latching member 64 to move freely. The magnetic field generated by the solenoid coil 58 applies an opposite force pushing latching member 64 away from the locking member 60. Once the latching member 64 reaches its unlocked position at some set distance from the locking member 60, as determined by the sensor 62, the solenoid coil 58 can reverse polarity of the magnetic field, thereby drawing the latching member 64 back into the locked position when desired.

Figure 5:
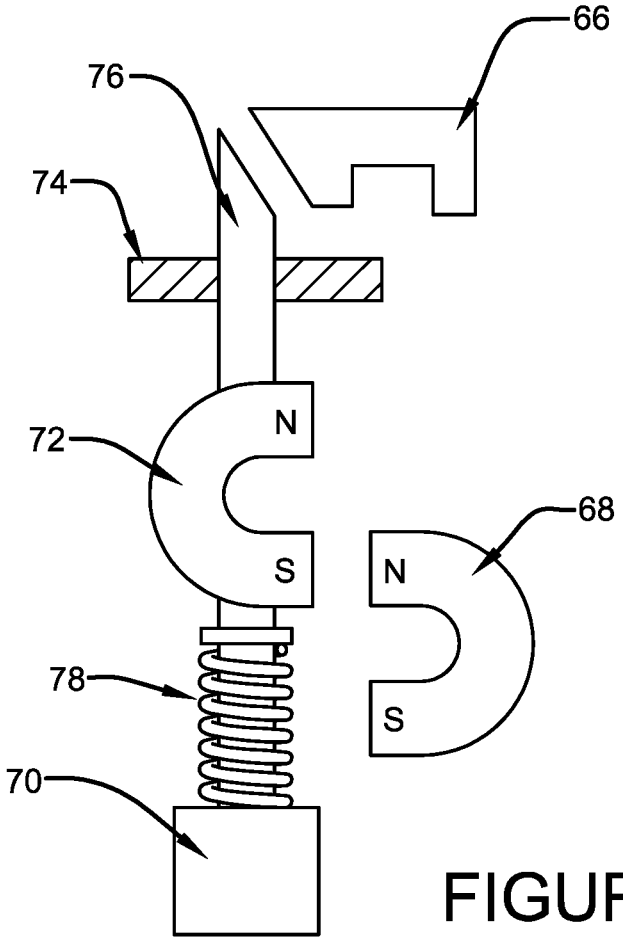
FIG. 5 is another embodiment of a powered latching apparatus, utilizing a series of magnets.

With reference to FIG. 5, another embodiment of the latching apparatus is shown. According to this embodiment, to move from an unlocked position to a locked position, the latching member 66 is manually moved towards the locking member 76. Concurrent to this action, the latch magnet 68 moves towards the receiver magnet 72. As the latch magnet 68 enters the magnetic field of the receiver magnet 72, the receiver magnet 72 automatically attracts the latch magnet 68. As the latching member 66 contacts the locking member 76, the locking member 76 retracts and allows the latching member 66 to pass. Once the latching member 66 has cleared the locking member 76, the spring 78 returns the locking member 76 to its original position which can lock the latching member 66 in place.

With continued reference to FIG. 5, according to this embodiment, when moving from a locked position to an unlocked position, the actuator 70 actuates and moves the receiver magnet 72 and the locking member 76 away from the latching member 66. The movement of the receiver magnet 72 aligns the poles of the receiver magnet 72 with the poles of the latch magnet 68 thereby creating a repelling force that can drive the latch magnet 68 and the latching member 66 away from the locking member 76.

The latching apparatus can be used on any type of door, including appliances such as a refrigerator, dishwasher, washing machine, or the like. The utility of this latching apparatus lies in the ease in which they can be closed coupled with the power assisted opening.

According to one embodiment, a 2-magnet version of the latching device is used. In the 2-magnet version, a magnet is rotated from North to South by a set of gears. As the magnet rotates, the corresponding stationary magnet in the latch striker receives either an attracting or repelling magnetic force. When the stationary magnet in the DID receives a repelling force, the user is granted aid in the opening of the DID. When the stationary magnet in the DID receives an attracting force, the act of completing the closing and latching of the unit is aided.

Figure 6:
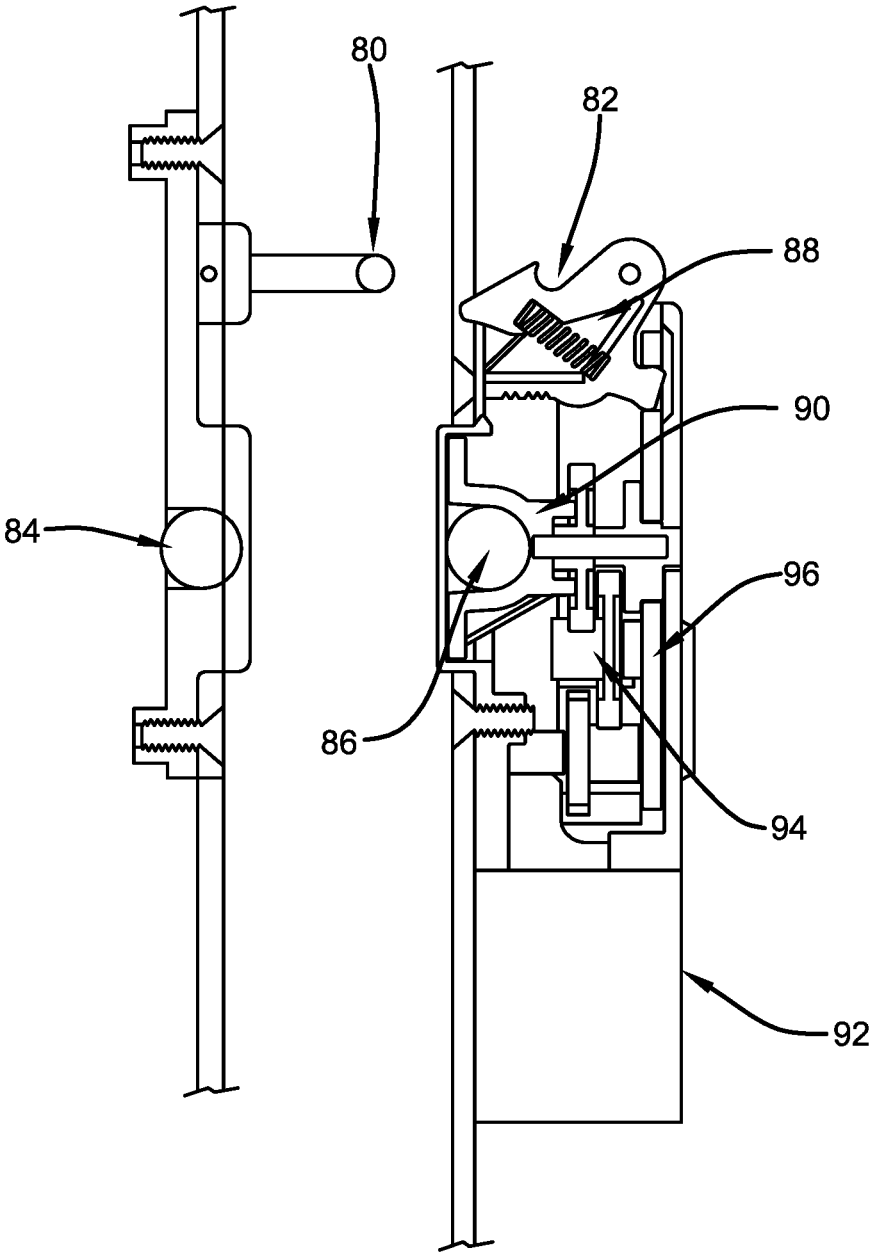
FIG. 6 is another embodiment of a powered latching apparatus, utilizing a different series of magnets.

With reference to FIG. 6, another embodiment of the latching apparatus is shown. According to this embodiment, to move from an unlocked position to a locked position, the latching member 80 is manually moved towards the locking member 82. Concurrent to this action, the latch magnet 84 moves towards the receiver magnet 86. When in an unlocked position, the receiver magnet 86 is oriented by the magnet rotator 90 so as to allow the polarity of the receiver magnet 86 to be opposite that of the latch magnet 84. As the latch magnet 84 enters the magnetic field of the receiver magnet 86, the receiver magnet 86 automatically attracts the latch magnet 84. As the latching member 80 contacts the locking member 82, the locking member 82 retracts and allows the latching member 80 to pass. Once the latching member 80 has cleared the locking member 82, the spring 88 returns the locking member 82 to its original position which can lock the latching member 80 in place.

With continued reference to FIG. 6, to move from a locked position to an unlocked position, an actuator 92 causes a series of gears 94 to rotate. The rotation of the gears 94 causes the magnet rotator 90 to rotate in a manner that orients the receiver magnet 86 in such a way that the polarity of the receiver magnet 86 is the same as that of the latch magnet 84. This likeness in polarity causes the latch magnet 84 to be driven away from the receiver magnet 86.

With continued reference to FIG. 6, the activation of the actuator 92 causes the cam plate 96 to move. The movement of the cam plate 96 causes the locking member 82 to move away from the latching member 80. As the latch magnet 84 is pushed away from the receiver magnet 86, the latching member 80 is allowed to pass over the locking member 82. When the latching member 80 has fully traversed over the locking member 82, the spring 88 returns the locking member 82 to its original position.

According to one embodiment, a 3-magnet version of the latching device is used. In the 3-magnet version, the cam plate pivots a magnet toggle. The magnet toggle is able to expose the stationary magnet located on the DID to either one of two magnets housed within the main door of the unit. The magnets housed within the toggle are positioned so that the polarities of the magnets are oriented in opposite directions; North is facing out on one magnet, while South is facing out on the other magnet. As the toggle pivots, the corresponding stationary magnet in the latch striker, located on the DID, receives either attracting or repelling magnetic forces. When the stationary magnet in the DID receives a repelling force, the user is granted aid in the opening of the DID. When the stationary magnet in the DID receives an attracting force, the act of completing the closing and latching of the unit is aided.

Figure 7:
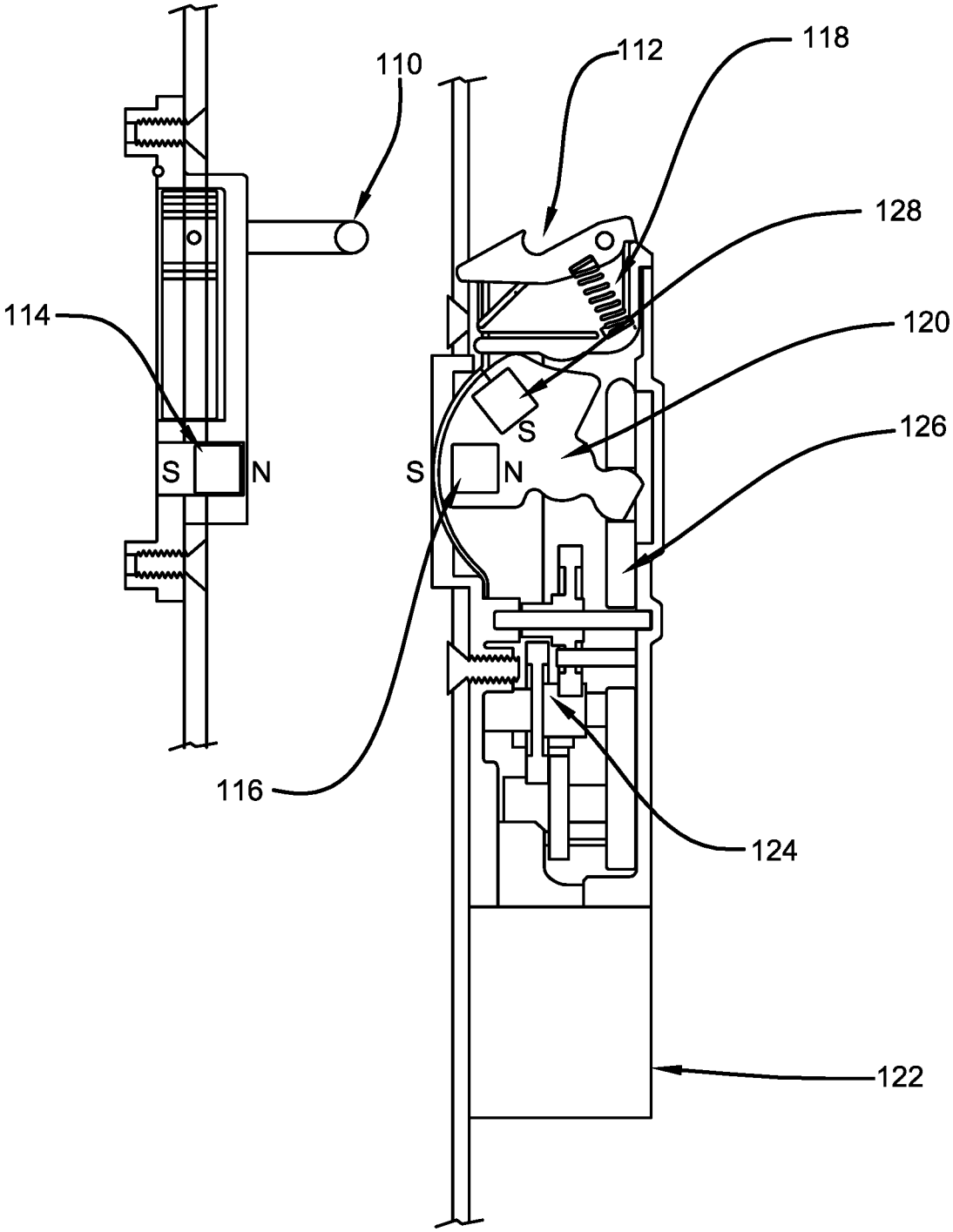
FIG. 7 is another embodiment of a powered latching apparatus, utilizing yet another series of magnets.

With reference to FIG. 7, another embodiment of the latching apparatus is shown. According to this embodiment, to move from an unlocked position to a locked position, the latching member 110 is manually moved towards the locking member 112. Concurrent to this action, the latch magnet 114 moves towards the receiver magnet 116. When in an unlocked position, the receiver magnet 116 is oriented so as to be in the dominant position by the magnet toggle 120. The polarity of the receiver magnet 116 is opposite that of the latch magnet 114, causing the latch magnet 114 to be drawn towards the receiver magnet 116. As the latch magnet 114 enters the magnetic field of the receiver magnet 116, the receiver magnet 116 automatically attracts the latch magnet 114. As the latching member 110 contacts the locking member 112, the locking member 112 retracts and allows the latching member 110 to pass. Once the latching member 110 has cleared the locking member 112, the spring 118 returns the locking member 112 to its original position which can lock the latching member 110 in place.

With continued reference to FIG. 7, to move from a locked position to an unlocked position, an actuator 122 causes a series of gears 124 to rotate. The rotation of the gears 124 causes the magnet toggle 120 to rotate in a manner that orients the receiver magnet 116 away from the latch magnet 114. The rotation of the magnet toggle 120 exposes the repelling magnet 128. The repelling magnet 128 has a polarity that is the same as that of the latch magnet 114. This likeness in polarity causes the latch magnet 114 to be driven away from the repelling magnet 128.

With continued reference to FIG. 7, the activation of the actuator 122 causes the cam plate 126 to move. The movement of the cam plate 126 causes the locking member 112 to move away from the latching member 110. As the latch magnet 114 is pushed away from the repelling magnet 128, the latching member 110 is allowed to pass over the locking member 112. When the latching member 110 has fully traversed over the locking member 112, the spring 118 returns the locking member 112 to its original position.

As described above, the present disclosure has been described with preferred embodiments thereof and it is understood that many changes and modifications to the described embodiments can be carried out without departing from the scope and the spirit of the present disclosure that is intended to be limited only by the appended claims.

We claim:

1. An apparatus for latching a door comprising:

a latching member connected to the door;

a locking member connected to a frame of the door;

wherein the latching member is manually moved towards the locking member to move the apparatus from an unlocked position to a locked position;

at least two magnets wherein at least one magnet of the at least two magnets is a latching magnet associated with the latching member and wherein at least one magnet of the at least two magnets is a receiver magnet associated with the locking member;

a magnet rotator for orienting the receiver magnet in the unlocked position so as to allow a polarity of the receiver magnet to be opposite that of the latching magnet, wherein, concurrent to manual movement of the latching member, the latching magnet associated with the latching member moves towards the receiver magnet associated with the locking member such that the at least two magnets attract;

a spring connected to the locking member, wherein as the latching member is manually moved into contact with the locking member, the locking member retracts and allows the latching member to pass, such that the spring returns the locking member to an original position to lock the latching member in place;

an actuator that causes gears to rotate, wherein rotation of the gears causes the magnet rotator to rotate in a manner that orients the receiver magnet in such a way that the polarity of the receiver magnet is the same as that of the latching magnet so that likeness in polarity causes the latching magnet to be driven away from the receiver magnet; and a pivoting cam, moved by the actuator, wherein the pivoting cam is rotatable about an axis to cause the locking member to move away from the latching member;

wherein magnetic force between the latching magnet and the receiver magnet is able to drive the latching member away from the locking member to allow the latching member to pass over the locking member.

2. The apparatus of claim 1, wherein the at least two magnets consist of the latching magnet and the receiver magnet.

3. The apparatus of claim 2, wherein the gears rotated by the actuator comprises a series of gears, wherein rotation of the gears causes the magnet rotator to rotate in such a way so as to expose a polarity of the receiver magnet to a same polarity of the latching magnet.

4. The apparatus of claim 1, wherein the actuator moves the pivoting cam, causing the locking member to move away from the latching member in such a way that allows for the latching member to pass over the locking member.

5. The apparatus of claim 1, wherein the spring acts to place the locking member back in the original position when the latching member has fully traversed over the locking member.

* * * * *